United States Patent [19]

Fujitaki

[11] 4,168,854

[45] Sep. 25, 1979

[54] TOGGLE LOCK

[75] Inventor: Roy K. Fujitaki, Altadena, Calif.

[73] Assignee: VSI Corporation, Pasadena, Calif.

[21] Appl. No.: 870,142

[22] Filed: Jan. 17, 1978

[51] Int. Cl.[2] ..... E05C 1/14

[52] U.S. Cl. ..... 292/139; 292/153; 403/152

[58] Field of Search ..... 292/139, 153, 158, 167, 292/186, 256.69, 26, 36, 223, 233, 196, 48, 82, 97, 123; 403/152, 150, 154

[56] References Cited

U.S. PATENT DOCUMENTS

| | | | |
|---|---|---|---|
| 202,186 | 4/1878 | Montgomery | 292/139 |
| 1,299,177 | 4/1919 | Halinka | 292/DIG. 31 X |
| 2,348,065 | 5/1944 | George | 292/1 |
| 2,468,406 | 4/1949 | Mora | 292/153 X |
| 2,668,076 | 2/1954 | Troche et al. | 292/DIG. 31 X |
| 3,034,327 | 5/1962 | Garmon, Jr. et al. | 292/139 X |
| 3,145,040 | 8/1964 | Phelps | 292/196 X |
| 3,151,375 | 10/1964 | Schevenell | 292/167 X |
| 3,680,901 | 8/1972 | Biebuycle | 292/36 |
| 4,025,096 | 5/1977 | Geer | 292/158 |

FOREIGN PATENT DOCUMENTS

| | | | |
|---|---|---|---|
| 39889 | 2/1929 | Denmark | 292/167 |
| 595627 | 7/1959 | Italy . | |
| 119133 | 6/1947 | Sweden | 292/139 |
| 341214 | 1/1931 | United Kingdom | 292/139 |

*Primary Examiner*—Roy D. Frazier
*Assistant Examiner*—William E. Lyddane
*Attorney, Agent, or Firm*—Irvin A. Lavine

[57] ABSTRACT

A lock in which a bolt is slidable by rotation of a pivoted handle connected to the bolt by a toggle link pin-connected to the bolt and handle. The handle is channel-shaped in cross section, and conceals and protects the bolt and toggle link in the locked position. The handle moves through 180° between locked and unlocked positions. A key operated barrel lock has an exterior detent through which the bolt passes, in the release position of the barrel lock, and the bolt has a recess which receives the key-operated barrel lock in the locked position thereof.

14 Claims, 5 Drawing Figures

TOGGLE LOCK

BACKGROUND OF THE INVENTION

The present invention relates to a lock construction in which a sliding bolt is moved by a pivoted handle.

There have been provided in the prior art various constructions in which a bolt is slidable by a pivoted handle, and in which the bolt may be selectively locked into the extended or locked position thereof by a key-operated barrel lock.

George U.S. Pat. No. 2,348,065 discloses a construction in which there is a sliding bolt that is spring urged into the extended or locked position, and which bolt is moved to the retracted position by a pivoted handle which overlies it, and has extending from it a lug which engages in a recess in the bolt. A key-operated barrel lock has a detent extending from it in the axial direction, the barrel lock being positioned generally at right angles to the bolt. The detent in one position of the barrel lock cooperates with a lug extending transversely of the bolt, in order to lock the bolt against opening movement. This construction results in a lock which is comparatively thick or deep, due to the fact that the depth dimension must be the sum of the axial length of the key-operated lock and the thickness of the bolt. In addition, a separate plate must be provided in this construction in order to conceal and protect the bolt.

Halinka U.S. Pat. No. 1,299,177 provides a lock construction including a bolt which is slidable, and has a yoke providing an aperture, and at its rear end has a head, for locking. The bolt is spring urged in the extended position. A handle is mounted in a recess in the housing which supports the bolt, and covers and conceals the bolt in the locked position of the bolt. The handle is pivoted, and has a lug extending downwardly into the yoke, so as to effect movement of the bolt. In axial alignment with the bolt there is provided a combination lock, at the rear of the bolt, the lock having within the housing a disk with an opening in it, the disk being posibionable so that the opening is aligned with the head of the bolt, located at the rear end of the bolt, thereby permitting movement of the bolt towards the retracted position when the handle is operated and the slot in the locking disk is aligned with the head of the bolt. This construction requires a relatively long construction, since the combination lock is in alignment with the bolt.

Troche et al U.S. Pat. No. 2,668,076 discloses a lock construction in which a bolt is slidable in a housing, and is spring urged to the extended position. The bolt has an opening which receives a lug of a pivoted handle, so that upon pivoting of the handle, the bolt is urged against the spring force to the withdrawn position. The handle is positioned in a recess of the housing, and has an additional plate which serves to cover and protect the bolt. At the rear end of the bolt, there is provided a key-operated barrel lock, having a radial extension which may be positioned in alignment with the bolt, so as to block movement of it, or positioned out of alignment, so as to permit movement of the bolt. The barrel lock is in axial alignment with the bolt, and thereby provides a construction which is relatively long.

Swedish Pat. No. 119,133 discloses a hasp-like lock construction in which a bolt is slidable by a link which is pivoted to the bolt and to a handle which is pivoted between a bolt-open position and a locked position. In the locked position, the handle overlies the link and the bolt, and has an opening which receives a staple. The staple may receive a separate securing device, which will prevent opening movement of the handle. The securing device may be a peg or a pad lock, and thus this construction is not an integral lock construction.

Biebuyck U.S. Pat. No. 3,680,901 discloses a lock or latch for a door, being mounted in an edge of the door. A sliding bolt is provided, which is extended and retracted by pivotal movement of a handle which is pivotably supported on a housing, and which is pivoted to the bolt.

Italian U.S. Pat. No. 595,627 also shows a construction in which a sliding bolt is connected to a rotating handle by a link which is pin connected to the end of the rotating handle and an end of the bolt. The handle is pivoted intermediate its ends, and pivoting movement of the handle serves to shift the bolt axially between extended and retracted positions.

Montgomery U.S. Pat. No. 202,186 discloses a lock construction in which a plate supports a bolt for sliding movement, being mounted on the under side of the plate. On the upper side of the plate is a handle construction, the handle being pivoted at one end to the plate, and having a crank mechanism to which is pivotally connected a link, the link being connected at its other end to a lug of the bolt which extends through a slot in the plate. Rotational movement of the handle thereby effects sliding movement of the bolt between extended and retracted positions. The handle is open, exposing the connecting link and the crank of the handle, and in this construction there is not provided a lock of any type.

SUMMARY OF THE INVENTION

There is disclosed herein a lock which has a housing in which is mounted a slidable bolt. The bolt is moved by rotation of a pivoted handle, there being a toggle link which is pin-connected to the handle intermediate its ends, and which is also pin-connected to the rear end of the bolt. The housing is in the form of a block, and has a first bore which is laterally off set, for the bolt. A second bore extends transversely to the first bore, and receives a key-operated barrel lock. The two bores are intersecting, and the barrel lock is provided with a recess in its exterior which may be positioned in adjacent relationship to the bolt, so that the bolt may pass through this recess in the exterior of the barrel lock and thereby slide between its extended and retracted positions. The bolt has a recess which is adjacent the barrel lock in the extended position of the bolt, and the barrel lock may be rotated so that a portion of its periphery enters into this recess, thereby locking the bolt against retracting movement. The housing includes an extended plate which underlies the bolt, and has a pair of upstanding posts at its end remote from the housing. The handle is pivotally connected to these posts. The handle is in the shape of a channel, and in the closed position of the handle when the bolt is extended into the locked position, the web of the channel overlies and is substantially parallel to the plate which extends from the housing, the flanges forming a part of the channel-shaped handle extending to and substantially engaging the extending plate of the housing, thereby providing an encompassing and covering and protective arrangement by the handle for the bolt, as well as for the toggle link which connects the handle and the bolt. The handle extends to and abuts the housing. The toggle link has first and second off set portions. The handle is provided on its under side with a pair of U-shaped extensions which are in facing relationship, and the arms of which are substantially perpendicular to the flanges of the handle. An end of the toggle link has an axle passing through it, and the axle is received in the spaces between the respective arms of the U-shaped protrusions. A fastening element, such as a screw, is inserted into each of the U-shaped protrusions, near the bight thereof, so that the teeth engage with the bight of the protrusions, and the head thereof overlies the axle, preventing withdrawal of the axle from the protrusions.

A flexible pin depends from the bolt, and in the withdrawn position engages a detent on the housing plate; the handle is thus capable of moving to an over-center, biased position. The pin engages a housing extension in the extended position of the bolt, thus serving as a registering stop for the bolt recess relative to the cylinder lock.

Among the objects of the present invention are to provide a lock in which a handle covers and conceals a sliding bolt and the operating toggle link for it. Another object of the present invention is to provide a lock construction in which the handle cooperates with a housing block to provide a construction which will defeat attempts to force the lock by causing an instrument to engage the handle and force the handle towards opening movement. Another object of the present invention is the provision of a lock which is compact, and which includes both a sliding bolt and a lock selectively to prevent movement of the bolt to retract position. Yet another object of the present invention is to provide a secure interlocking arrangement between a lock and a bolt, which will be steady and long lasting, but relatively trouble free. Still another object of the present invention is to provide a lock having a sliding bolt and a key or similar operated lock construction which does not rely upon spring action.

Other objects and many of the attendant advantages of the present invention will be more readily understood from the following specification, taken in conjunction with the appended drawings.

DESCRIPTION OF THE PREFERRED EMBODIMENT

Figure 1:
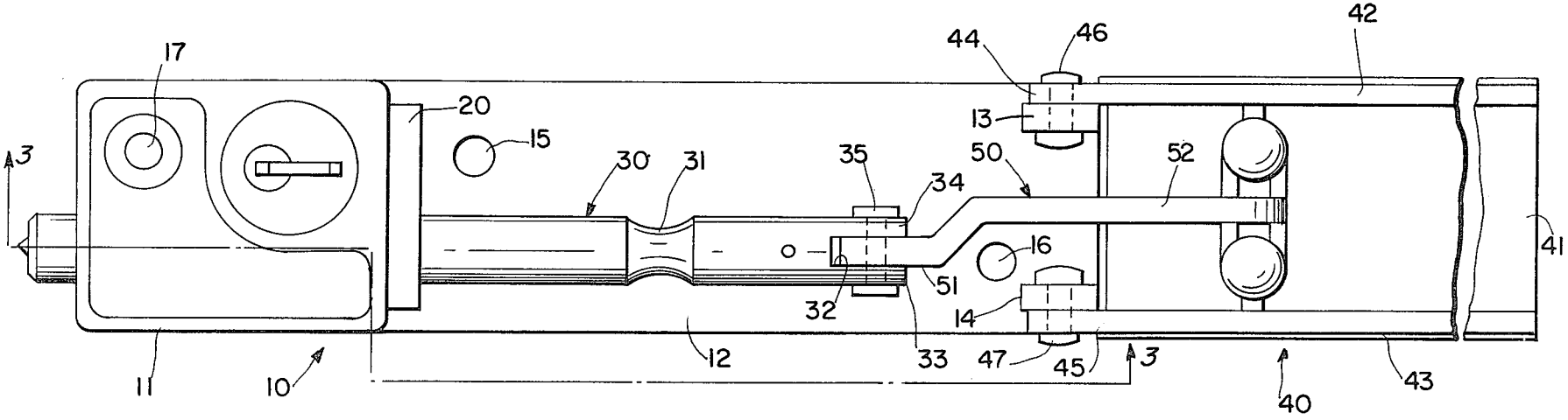
FIG. 1 is a plan view of the lock in accordance with the present invention, with the handle in the open position and with parts partially broken away.

Referring now to the drawings, wherein like or corresponding reference numerals are used to designate like or corresponding parts throughout the several views, there is shown in FIG. 1 a lock 10, which includes a generally block like housing designated 11, and having an elongate plate 12 extending therefrom. The plate 12, at the end opposite the housing 11, has a pair of upstanding posts 13 and 14. A bolt 30 is slidable in the housing 11, and is operated by a handle 40 which is operatively connected to the bolt 30 by a toggle link 50. The handle 40 may be seen to comprise a web portion 41, and a pair of flanges 42 and 43 which extend generally perpendicularly to the web 41, so that the handle 40 is of channel-shape in transverse cross section; see also FIG. 5. Handle 40 has extending from the flange 42 an apertured ear 44, and from the flange 43 an apertured ear 45. Rivets or similar pivot pin elements 46 and 47 extend through the ear 44 and post 13, and through the ear 45 and post 14, respectively, to thereby pivotally connect the handle 40 to the plate 12.

The bolt 30 is of cylindrical construction, and has a recess 31 intermediate its ends. At its rear end, bolt 30 is bifurcated, so that there is provided a slot 32 between ears 33 and 34. These ears are apertured, and receive through them a pin connection 35, preferably in the form of a rivet, which also extends through an aperture in a portion 51 of the link 50, to thereby pin-connect link 50 to bolt 30. The link 50 has a portion 52 which is connected in a manner to be hereinafter discussed to the handle 40, the portion 52 being laterally off set from the portion 51 of the link 50.

The lock 10 may be mounted to a support, as by screws or bolts, and for this purpose there are provided in the plate 12 openings 15 and 16; in addition, an aperture 17 extends through the block or housing 11.

Figure 2:
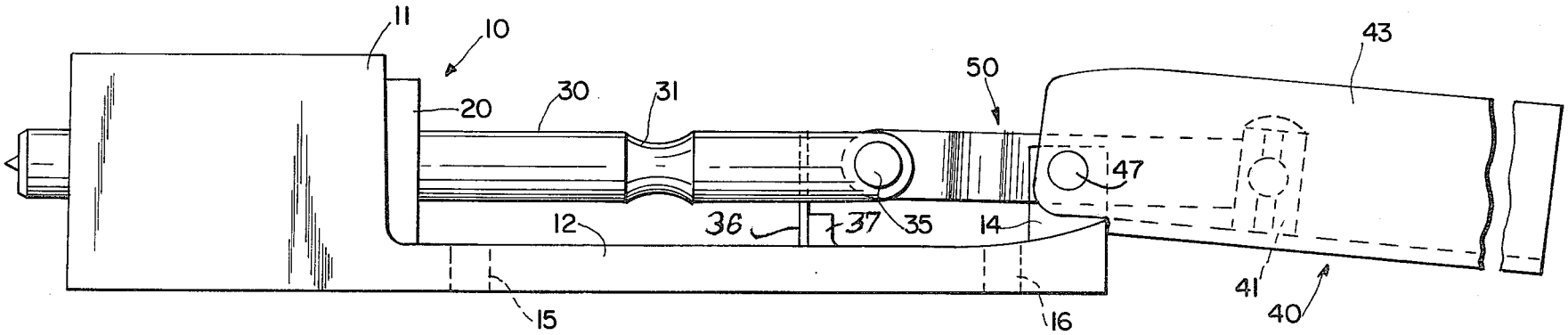
FIG. 2 is a side elevation of the lock of FIG. 1.

In FIG. 2, the handle 40 is shown in the open position, and it will be understood that in this position the bolt 30 is in the retracted position thereof, so that the lock is open.

Figure 3:
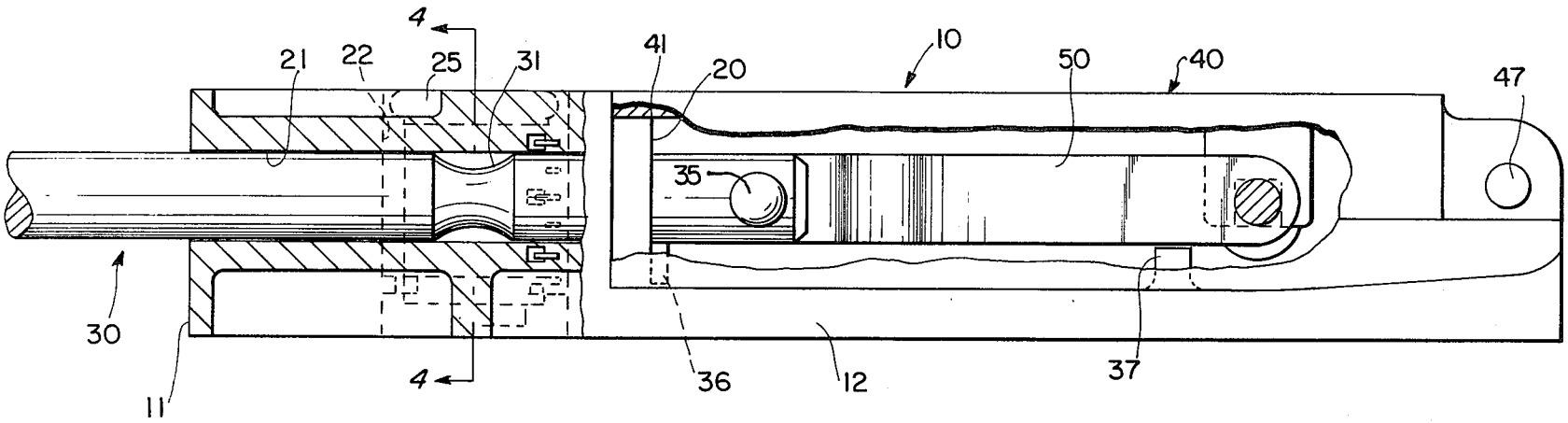
FIG. 3 is a cross sectional view, with parts in elevation and broken away, taken on the line 3—3 of FIG. 1 with the handle in closed position and the bolt extended.

The lock 10 is shown in FIG. 3 in the closed position, with the bolt 10 extended, and as may be seen, bolt 30 extends substantially outwardly of the housing 11. Bolt 30 slides in a bore 21 in the housing 11. As may be seen in FIG. 4 the housing 11 has a second bore 22 which has the axis thereof transverse to the axis of the bore 21, these axes being in spaced relationship, but the bores are in communication with each other, since the axes and diameters are related so that the bores intersect. A key-operated barrel lock 25 is positioned in the bore 22, and is provided on the exterior thereof with a recess 26. The barrel lock 25 is rotatable on its axis in the bore 22 of housing 11, so that the recess 26 may be positioned substantially 180° from the position shown in FIG. 4, and thereby the recess 26 will receive the bolt 30, and permit sliding movement of the bolt. In the position shown in FIG. 4, the key-operated barrel lock 25 is in the locked position, with a portion of the periphery thereof entering into the recess 31 of bolt 30, and thereby prevents sliding movement of the bolt 30. Thus, the outer periphery of the key-operated barrel lock 25 serves as a detent to prevent movement of the bolt 30 in the retracting or opening direction. As a consequence it is this exterior portion of the barrel lock 25 which resists retracting or opening movement of the bolt 30.

Figure 4:
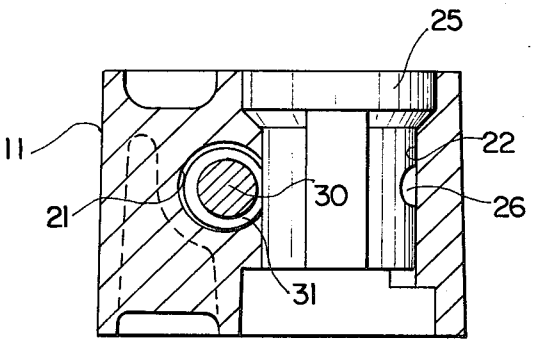
FIG. 4 is a cross sectional view taken on the line 4—4 of FIG. 3.

Referring again to FIG. 3, there may be seen the handle 40 in the closed position thereof. In this position, the forward or left end of the handle 40, which is opposite the rivet 47, is in engagement with the right hand or rear edge of the block forming the housing 11. As may be seen in FIGS. 1, 2 and 3, the housing 11 has an extension 20 which has its upper surface below the upper surface of the block of housing 11, as shown in FIG. 2 and FIG. 3, and which has its side surfaces inwardly of the side surfaces of the block forming the housing 11, as shown in FIG. 1. As a result, the bottom of the web 41 may rest on the said upper surface of the extension 20, as shown in FIG. 3, and the upper surface of the handle 40, particularly the web 41 thereof, will be substantially in the same plane as the upper surface of the block forming the housing 11. Similarly, the exterior surfaces of the flanges 42 and 43 will be respectively in substantially the same planes as the side surfaces of the block forming the housing 11, as will be evident from FIG. 1, and due to the engagement of the edges of the flanges 42 and 43 with the upper surface of the plate 11, as shown in FIG. 3, and due to the substantial abutting of the forward ends of the web 41 and flanges 42 and 43 with the rear face of the housing 11, as shown in FIG. 3, there is a tight closure of the handle 40 against the housing 11 and plate 12, so as to prevent entry of a tool when the handle 40 is in the closed position as shown in FIG. 3, and when the barrel lock 25 is in the locked position as shown in FIG. 4.

It will be noted from FIG. 3 that the web 41, in the closed position of the handle, is substantially parallel to the plate 12. In the closed position, the handle 40 encompasses the link 50, as well as the rear end of the bolt 30 and the connection between the link 50 and the handle 40.

Referring again to FIG. 2, there will be seen extending from the bolt 30 a resilient pin 36, pin 36 extending toward the plate 12. The plate 12 has a stop or detent 37 extending towards the bolt 30. When the handle 40 is moved from the closed position to the open position thereof, at one point in its movement, when it has moved through substantially 180° from the closed position, three pivotal connections will lie in substantially the same plane, these being the pivotal connection between bolt 30 and link 50, the pivotal connection between link 50 and the handle 40, and the pivotal connection between the handle 40 and the upstanding posts 13 and 14 of the housing 11. It is when the handle 40 and the parts are in the noted position that the pin 36 will engage the stop or abutment 37; the handle 40 may be moved further, however, by a few degrees, due to the resiliency of pin 36, so that the pivotal connection between link 50 and handle 40 is now below (as shown in FIG. 2) a plane extending through the pivotal axis between bolt 30 and link 50 on the one hand and the pivotal axis between handle 40 and housing 11, on the other hand. This is an over-center position for handle 40, and it is spring urged into this open, over-center position, by the above noted relationships together with the engagement of resilient pin 36 with the stop or abutment 37.

In FIG. 3, it will be seen that the pin 36 engages a surface of the extension 20. This provides for relatively precise registry between the recess 31 on the bolt 30 and the cylinder lock 25. As a consequence of this construction, even after considerable useage and therefore wear of the lock 10, where the fit between the parts becomes looser, there will be effected the desired registration between the recess 31 and the cylinder lock 25.

In the closed position of cover or handle 40, after pin 36 strikes extension 20, the cover or handle 40 travels further a slight amount, to provide a resiliently urged, over center, closed position of cover or handle 40.

Figure 5:
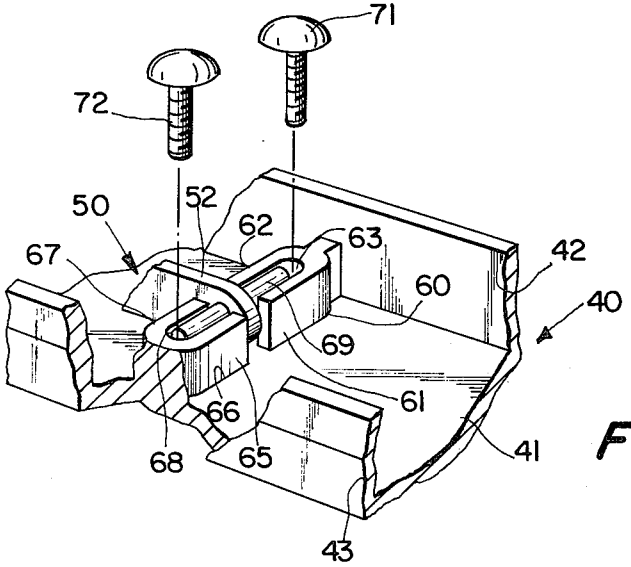
FIG. 5 is an exploded perspective view, with parts broken away, showing the connection between the toggle link and handle of the lock of FIG. 1.

Referring now to FIG. 5, there is shown the construction for connecting the link 50, and more particularly the portion 52 thereof, to the handle 40. As may be seen therein, there extends from the underside of the web 41 of handle 40 a pair of U-shaped protrusions, protrusion 60 including a pair of parallel arms 61 and 62, and having a bight portion 63; the protrusion 65 is similar, having arms 66 and 67, and a bight portion 68. The arms 61 and 62 are parallel to each other, and to the arms 66 and 67, and these arms are transverse of the flanges 42 and 43. An axle or pivot 69 extends into the spaces between the arms 61 and 62, and the arms 66 and 67, and the axle 69 is carried by the portion 52 of toggle link 50. A pair of screws 71 and 72 are provided, and are threaded into the U-shaped protrusions 60 and 65, the threads thereof engaging the bights 63 and 68, and the heads of the screws 71 and 72 overlying the ends of the axle 69 so as to secure axle 69 in the protrusions 60 and 65, and thereby provide for secure assemblage of the toggle link 50 with the handle 40. The shanks of the screws 71 and 72 may engage the ends of the axle 69, so as to ensure that the threads of the screws 71 and 72 have secure engagement with the material of the protrusions 60 and 66.

There has been provided a lock construction which is compact, and which provides great security against forced opening, as by pry bars or similar tools. The linkage which retracts the bolt is covered and protected by a handle, and the handle provides a protective shield about the linkage, engaging the housing and the plate. The herein provided lock construction requires no operating spring, and there is a secure and sturdy engagement of the barrel lock with the bolt, in the locked position of the barrel lock, so as to prevent opening of the lock, as by breaking of a lug or the like from either the bolt or the operating handle.

It will be obvious to those skilled in the art that various changes may be made without departing from the spirit of the invention, and therefore the invention is not limited to what is shown in the drawings and described in the specification but only as indicated in the appended claims.

I claim:

1. A lock construction comprising:

a housing comprising a substantially flat plate having an upstanding support for guiding a bolt, a slidable bolt carried by said support of said housing, means for causing sliding of said bolt comprising a pivoted handle on said plate and a linkage means interconnecting said bolt and said handle, said handle being channel-shaped in transverse cross section and having a web and a pair of flanges, said handle having a closed position encompassing said linkage means with said web substantially parallel to and spaced from said plate of said housing and said flanges engaging said plate, the outer surfaces of the handle web and flanges being substantially coplanar, respectively, with the outer surfaces of said support, and an end of said handle abutting said support.

2. The lock of claim 1, said housing plate at one end having post means extending transversely thereof, the webs of said handle being pivotally connected to said post means.

3. A lock construction as set forth in claim 1, wherein said linkage means comprises a toggle link and means for pivotally connecting said toggle link to said handle, said pivotal connecting means comprising means defining a pair of facing U-shaped protrusions on said web between said flanges, the arms thereof being aligned and transverse to said flanges, axle means in said protrusions and said link means journalled on said axle means, and means for retaining said axle means in said protrusions comprising fastener means secured to said protrusion and overlying said axle means.

4. The construction of claim 1, wherein said linkage means is pivotally mounted to said handle and said bolt, said handle being pivotable to an open position in which said pivotal connection of said linkage means to said handle is in over-center position relative to the pivotal connection of the handle to the housing and the pivotal connection of the linkage means to the bolt.

5. The lock of claim 4, a resilient pin carried by said bolt, and stop means on said housing engaged by said pin when said pivotal connections are substantially aligned in the open position of the handle.

6. The lock of claim 1, wherein said support extends transversely of said plate, said bolt passing through said support and a barrel lock in said support adjacent said bolt for selectively locking said bolt.

7. The lock of claim 6, said linkage means comprising a toggle link pivotally connected to said bolt and to said handle, said toggle link comprising first and second portions off-set from each other.

8. The lock of claim 7, wherein said first portion is pin connected to the rear end of said bolt and said second portion is pin connected to said handle.

9. The lock of claim 6, said barrel lock and said bolt comprising means for preventing movement of said bolt upon operation of said barrel lock.

10. The lock of claim 9, wherein the axes of said bolt and barrel lock are non-parallel, said bolt and said barrel lock each having a recess therein, said recess of said barrel lock having a portion of said bolt therein in the unlocked position thereof and the recess of said bolt having a portion of said barrel lock therein in the locked position of said barrel lock and bolt.

11. The lock of claim 10, and means for positioning said recess of said bolt in registry with said barrel lock comprising a detent carried by a movable element of said lock and engaging a fixed element of said lock when said bolt recess is in registery with said barrel lock.

12. The lock of claim 11, said detent being a pin carried by said bolt and engaging a surface of said housing.

13. A lock construction comprising:

a housing comprising a support for guiding a bolt, a slidable bolt carried by said support, means for causing sliding of said bolt comprising a handle, means pivotally connecting an end of said handle to said housing, and linkage means pivotally connected to said handle and said bolt, said handle being pivotable to a bolt retracted position in which said pivotal connection of said linkage means to said handle is in over-center position relative to the pivotal connection of the handle to the housing and the pivotal connection of the linkage means to the bolt, and means for resiliently biasing said handle in said over-center position comprising a resilient pin carried by said bolt, and stop means on said housing engaged by said pin when said pivotal connections are substantially aligned in the open position of the handle and further movement of said handle to said over-center position provides said biasing.

14. A lock construction comprising:

a housing comprising a support for guiding a bolt, a slidable bolt carried by said support, a handle of channel-shape and having a web and a pair of flanges, means pivotally connecting said handle to said housing, linkage means connecting said bolt to said handle comprising a toggle link and means for pivotally connecting said toggle link to said handle, said pivotal connecting means comprising means defining a pair of facing U-shaped protrusions on said web between said flanges, the arms thereof being aligned and transverse to said flanges, axle means in said protrusions and said link means journalled on said axle means, and means for retaining said axle means in said protrusions comprising fastener means secured to said protrusion and overlying said axle means.

* * * * *